US011478844B2

(12) United States Patent
Wang

(10) Patent No.: US 11,478,844 B2
(45) Date of Patent: Oct. 25, 2022

(54) RIVET GUN

(71) Applicants: HANGZHOU UNITED TOOLS CO., LTD., Hangzhou (CN); HANGZHOU GREAT STAR INDUSTRIAL CO., LTD., Hangzhou (CN)

(72) Inventor: Weiyi Wang, Hangzhou (CN)

(73) Assignees: HANGZHOU UNITED TOOLS CO., LTD., Hangzhou (CN); HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 2 days.

(21) Appl. No.: 17/263,341

(22) PCT Filed: Jul. 27, 2018

(86) PCT No.: PCT/CN2018/097447
§ 371 (c)(1),
(2) Date: Jan. 26, 2021

(87) PCT Pub. No.: WO2020/019303
PCT Pub. Date: Jan. 30, 2020

(65) Prior Publication Data

US 2021/0170475 A1 Jun. 10, 2021

(51) Int. Cl.
*B21J 15/04* (2006.01)
*B21J 15/16* (2006.01)
*B21J 15/38* (2006.01)

(52) U.S. Cl.
CPC ..... *B21J 15/383* (2013.01); *B21J 15/043* (2013.01); *B21J 15/16* (2013.01)

(58) Field of Classification Search
CPC ... B21J 15/10; B21J 15/16; B21J 15/26; B21J 15/386; Y10T 29/5377; Y10T 29/53709; Y10T 29/53713
(Continued)

(56) References Cited

U.S. PATENT DOCUMENTS 2,457,417 A 12/1948 Trautmann
3,886,782 A * 6/1975 Miyamoto ..... B21J 15/386 D8/51
(Continued)

FOREIGN PATENT DOCUMENTS

CN 2860756 Y 1/2007
CN 106363123 A 2/2017
(Continued)

OTHER PUBLICATIONS

PCT; App No. PCT/CN2018/097447; International Search Report and Written Opinion dated Apr. 12, 2019.

*Primary Examiner* — Sarang Afzali
*Assistant Examiner* — Darrell C Ford
(74) *Attorney, Agent, or Firm* — Fitch, Even, Tabin & Flannery LLP

(57) ABSTRACT

The present invention provides a rivet gun including a first handle, a second handle, a transmission mechanism, and a clamping-pulling mechanism. The first handle is fixedly connected or integrated with a housing limiting the clamping-pulling mechanism, and the second handle is rotatable around a first fixed shaft relative to the first handle; the clamping-pulling mechanism includes a pull rod with gear grooves thereon; the transmission mechanism includes a gear member with a gear end rotatable around a second fixed shaft, the gear end of the gear member being configured to engage with the gear grooves on the pull rod; and the second handle is connected to the transmission mechanism, and configured to drive the gear member of the transmission mechanism to rotate when the second handle is rotated and opened relative to the first handle such that the gear member pushes the pull rod forward by engagement between the gear end and the gear grooves, and to drive the gear member of the transmission to rotate when the second handle is rotated and closed relative to the first handle such that the gear end
(Continued)

of the gear member pulls the pull rod backward by engagement between the gear end and the gear grooves.

8 Claims, 4 Drawing Sheets

(58) Field of Classification Search
USPC ..... 29/243.53, 243.5, 243.51
See application file for complete search history.

(56) References Cited

U.S. PATENT DOCUMENTS 3,961,517 A * 6/1976 DiMaio ..... B21J 15/386 74/89.17
4,353,239 A * 10/1982 Fujimoto ..... B21J 15/043 29/243.528
4,354,375 A * 10/1982 Lesowsky ..... B25B 27/0007 72/449
4,807,460 A * 2/1989 Tzong ..... B21J 15/386 29/243.53
6,085,400 A * 7/2000 Liu ..... B21J 15/043 227/55
8,776,338 B2 7/2014 Yuan
2006/0230810 A1 10/2006 Gallentine et al.
2014/0137379 A1* 5/2014 Yuan ..... B21J 15/105 29/243.521

FOREIGN PATENT DOCUMENTS

CN 206234334 U 6/2017
CN 206305373 U 7/2017
CN 206981703 U 2/2018
FR 1464977 A 1/1967
GB 477328 A 12/1937

* cited by examiner

RIVET GUN

FIELD OF THE INVENTION

The present invention relates to hand tools, and in particular, relates to a rivet gun.

DESCRIPTION OF THE PRIOR ART

A traditional connecting-rod-type rivet gun includes a handle and a pull rod. The handle, the pull rod and a connecting rod of the rivet gun form a planar linkage structure. During use, the handle is closed, and hence the pull rod is folded by virtue of action of the connecting rod, and the pull rod breaks the rivet by a clamping port. In this way, during the course of pulling the pull rod, the pull rod is subjected to an oblique pulling force of the connecting rod. Therefore, in the force applied to the pull rod, a larger component force perpendicular to the pull rod is present, and if the force is uneven, the pull rod may be tilted, resulting in a poor quality or even a failure of riveting. In addition, when the component force perpendicular to the pull rod becomes greater, a component force parallel to the pull rod becomes smaller, such that a resultant force required to break the same rivet becomes greater, and thus the manual rivet gun is laboring in use. Therefore, a more reliable and labor-saving rivet gun is desired in the prior art.

SUMMARY OF THE INVENTION

In view of the above-mentioned drawbacks in the prior art, the technical problem to be solved by the present invention is to provide a more reliable and labor-saving rivet gun.

To achieve the above object, the present invention provides a rivet gun. The rivet gun includes a first handle, a second handle, a transmission mechanism, and a clamping-pulling mechanism. The first handle is fixedly connected or integrated with a housing limiting the clamping-pulling mechanism, wherein the second handle is rotatable around a first fixed shaft relative to the first handle. The clamping-pulling mechanism includes a pull rod with gear grooves thereon. The transmission mechanism includes a gear member with a gear end rotatable around a second fixed shaft, wherein the gear end of the gear member is configured to engage with the gear grooves on the pull rod. The second handle is connected to the transmission mechanism, and is configured to drive the gear member of the transmission mechanism to rotate when the second handle is rotated and opened relative to the first handle such that the gear member pushes the pull rod forward by engagement between the gear end and the gear grooves, and to drive the gear member of the transmission to rotate when the second handle is rotated and closed relative to the first handle such that the gear end of the gear member pulls the pull rod backward by engagement between the gear end the gear grooves.

In one embodiment, the transmission mechanism includes a connecting rod configured to transfer a motion of the second handle to the gear member. Further, a first end of the connecting rod is rotatably connected to the second handle by a first pin shaft, and a second end of the connecting rod is rotatably connected a tail end of the gear member by a second pin shaft. The second handle, the connecting rod, and the gear member are configured to define a double rocker mechanism. Connection lines of axes of the first fixed shaft, the second fixed shaft, the first pin shaft, and the second pin shaft are configured to define a parallelogram.

In another embodiment, the gear member is made of a plurality of pieces stacked on each other.

In another embodiment, a torsion spring is arranged between the first handle and the second handle.

In another embodiment, the clamping-pulling mechanism also includes a push rod, a spring, a claw, a restraining member, and a lead-in head. The claw is arranged in an inner cavity of the restraining member. The claw and the restraining member are provided with mutually-engaged ramps. The push rod and the spring are arranged in an inner cavity of the pull rod in turn. The restraining member is sleeved onto the pull rod. The clamping-pulling mechanism is configured such that when the pull rod is pushed forward, the lead-in head is abutted against the claw such that the claw compresses the spring by the push rod, the ramps are separated from each other, and the claw is opened, and when the pull rod is pulled back, under action of a restoring force of the spring, the push rod pushes the claw to cause the ramps to engage with each other, and the claw is tightened under a reaction force of the ramps.

In another embodiment, needles or balls are arranged between the pull rod and the housing. In other embodiments, the first handle and the second handle are each provided with a handle sleeve, wherein the handle sleeve of the first handle is provided with a protrusion suitable for grasping by fingers; the first handle and the second handle are further provided with a plurality of spare seekers of different specifications; and tail portions of the first handle and the second handle are each further provided with a snap fastener.

The present invention achieves the following beneficial effects: The gear engagement can achieve more straight-line drawing of the rivet than the connecting rod configuration; a radial component force of the pull rod is reduced, and the operation is labor-saving; with the effect of a lever, it is labor-saving to apply a force onto the handle; and by stamping of sheet metals into gears, the conventional gear milling process can be avoided and the cost can be reduced.

The concept, specific structure and resulting technical effect of the present invention are further described below in conjunction with the accompanying drawings to fully understand the object, feature and effect of the present invention.

DETAILED DESCRIPTION OF THE PREFERRED EMBODIMENTS

The present invention is further illustrated hereinafter with reference to the accompanying drawings and specific embodiments.

Figure 1:
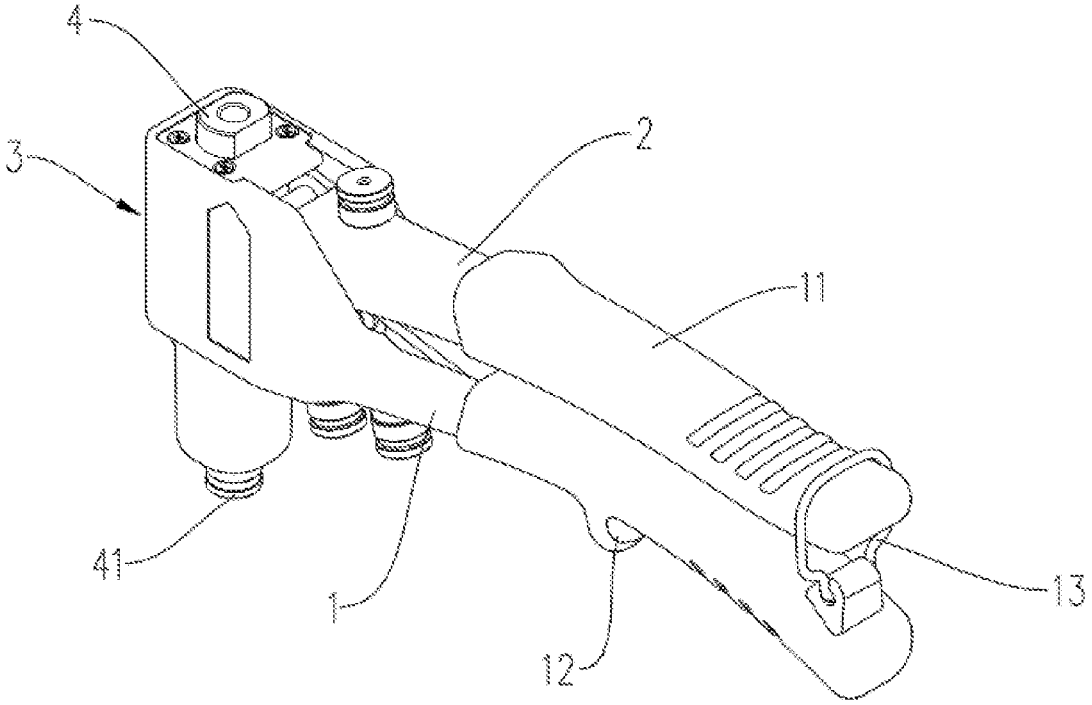
FIG. 1 is a schematic view of a rivet gun according to an embodiment of the present invention.
Figure 2:
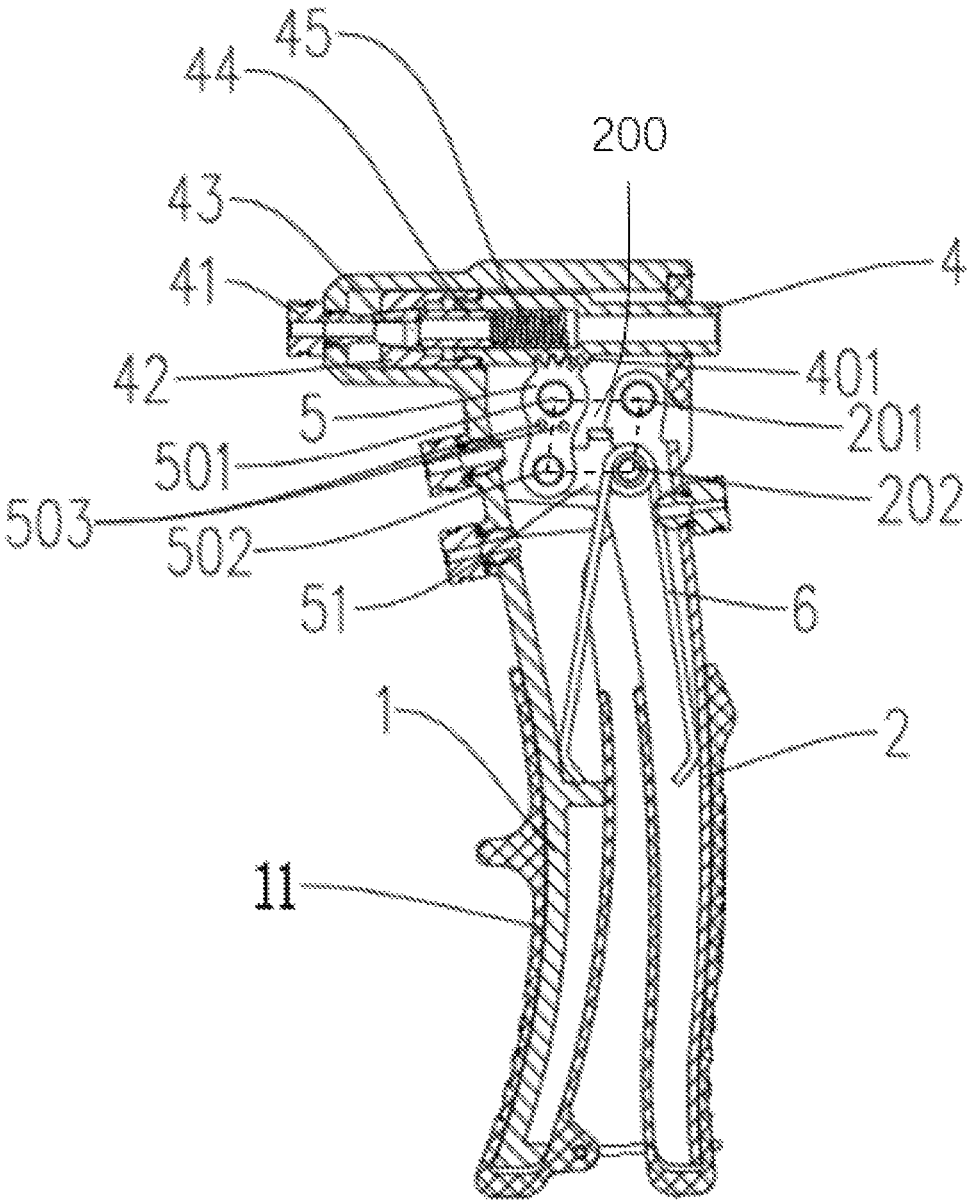
FIG. 2 is a sectional view of FIG. 1.
Figure 3:
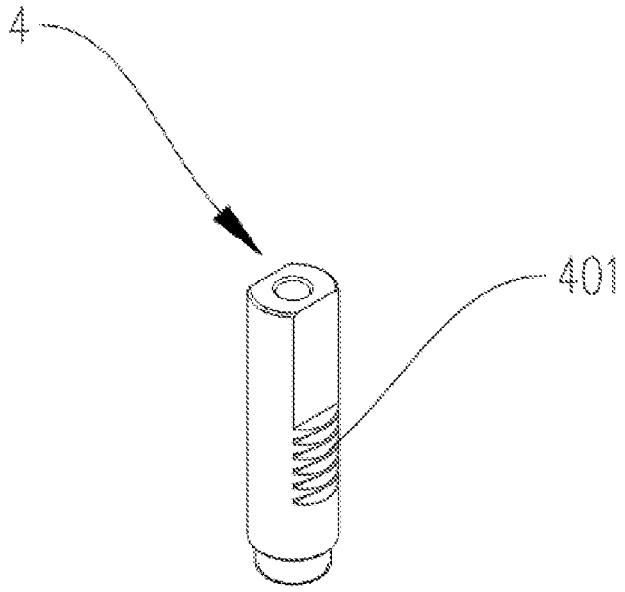
FIG. 3 is a schematic view of the pull rod in FIG. 1.

As shown in FIGS. 1, 2, and 3, the rivet gun according to a specific embodiment of the present invention includes a handle 1 and a handle 2. The first handle 1 is fixedly connected or integrated with a housing 3 of a body of the rivet gun, and the handle 2 is rotatable around a fixed shaft 201 relative to the handle 1.

The rivet gun according to the present invention further includes a transmission mechanism and a clamping-pulling mechanism. In this embodiment, the transmission includes a gear member 5 rotatable around a fixed shaft 501. The gear member 5 includes a gear end. The clamping-pulling mechanism includes a pull rod 4. The pull rod 4 is provided with gear grooves 401. The gear end of the gear member 5 engages with the gear grooves 401 on the pull rod 4. Open and close actions of the handle 2 of the rivet gun according to the present invention drive the gear member to rotate, and then by engagement between the gear member and the gear grooves, a motion is transferred to the pull rod 4, which is finally converted to a linear movement of the pull rod 4. For those skilled in the art, such transmission can be practiced in a variety of forms and mechanisms, such as a gear mechanism, or a linkage mechanism disclosed below, which is not limited in the present invention. In this embodiment, the transmission mechanism includes a connecting rod 51, wherein one end of the connecting rod 51 is rotatably connected to the handle 2 by a pin shaft 202, and the other end of the connecting rod 51 is rotatably connected to the gear member 5 by a pin shaft 502. The handle 2, the gear member 5, and the connecting rod 51 define a double rocker mechanism in practice. In this embodiment, connection lines between the fixed shafts 201 and 501 and the pin shafts 202 and 502 define a parallelogram 200. In this embodiment, the clamping-pulling rod further includes a push rod 44, a spring 45, a claw 43, a restraining member 42, and a lead-in head 41. The claw 43 is arranged in an inner cavity of the restraining member 42. The claw 43 and the restraining member 42 are provided with mutually-engaged ramps. The push rod 44 and the spring 45 are arranged in an inner cavity of the pull rod 4 in sequence. The restraining member 42 is sleeved onto the pull rod 4. The clamping-pulling mechanism according to this embodiment is such configured that when the pull rod 4 is pushed forward, the lead-in head 41 is abutted against the claw 43 such that the claw 43 compresses the spring 45 by the push rod 44, the ramps are separated from each other, and the claw 43 is opened, and when the pull rod 4 is pulled back, under action of a restoring force of the spring 45, the push rod 44 pushes the claw 43 to cause the ramps to engage with each other, and the claw 43 is tightened under a reaction force of the ramps.

Figure 4:
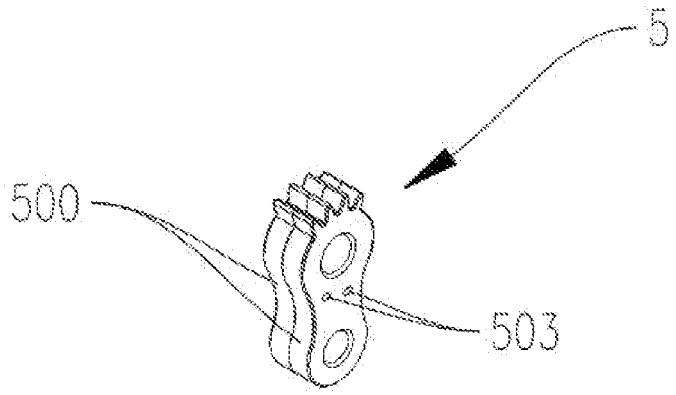
FIG. 4 is a schematic view of the gear member in FIG. 1.

As shown in FIG. 4, the gear member 5 according to this embodiment is made of a plurality of gear pieces 500 stacked on each other by pin shafts 503. The gear pieces are made of a spring steel (65 Mn) or a carbon steel, and the gears are formed by stamping of sheet metals, such that the conventional gear milling process is not needed and the cost is reduced. Where the gear pieces are small, the gear pieces are preferably made of a spring steel to ensure the strength thereof; and where the gear pieces are larger, the gear pieces may be selectively made of the common carbon steel.

Figure 5:
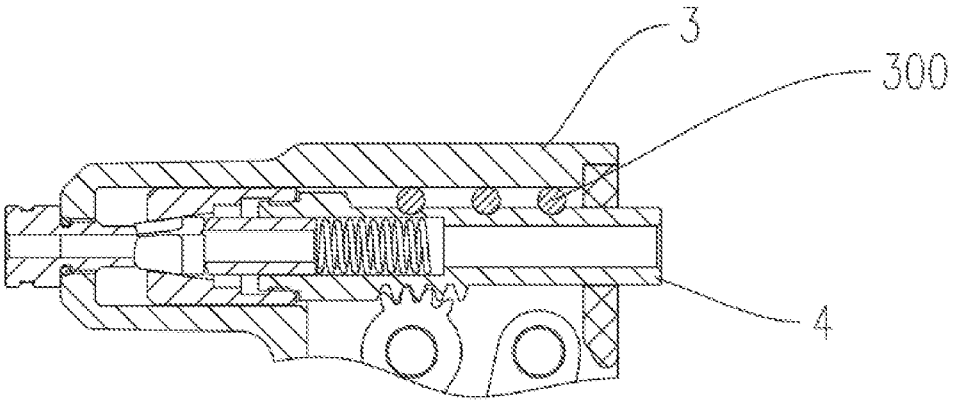
FIG. 5 is a schematic view of balls according to an embodiment of the present invention.
Figure 6:
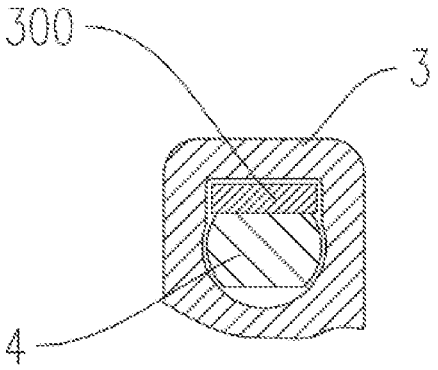
FIG. 6 is a schematic view of needles according to an embodiment of the present invention.

As shown in FIGS. 5 and 6, in order to ensure a sufficient support for and prevent severe friction against the pull rod 4 when the push rod 4 linearly reciprocates, balls or needles 300 may be arranged between the pull rod 4 and the housing 3 to implement a rolling friction between the pull rod 4 and the housing 3, reduce wear between the pull rod 4 and the housing 3, and prolong lifetime of the product.

In addition, a torsion spring 6 is arranged at the pin shaft 202 on the handle 2, such that the handle 2 has a reset function; handle sleeves 11 are arranged on the handles, and a protrusion 12 suitable for grasping by fingers is arranged on the handle sleeve 11 of the handle 1; a plurality of spare seekers 41 of different specifications are further arranged on the handles; and snap fasteners 13 are further arranged on the handles.

Described above are preferred embodiments of the present invention. It should be understood that persons of ordinary skill in the art would derive various modifications and variations in accordance with the concept of the present invention without paying any inventive effort. Therefore, any technical solution derived by a person skilled in the art, in accordance with the concept of the present invention, by logical analysis, reasoning or limited trials based on the prior art should be included within the protection scope subject to the appended claims.

The invention claimed is:

1. A rivet gun, comprising a first handle, a second handle, a transmission mechanism, and a clamping-pulling mechanism; wherein the first handle is fixedly connected or integrated with a housing limiting the clamping-pulling mechanism, and the second handle is rotatable around a first fixed shaft relative to the first handle;

the clamping-pulling mechanism comprises a pull rod with gear grooves thereon;

the transmission mechanism comprises a gear member with a gear end rotatable around a second fixed shaft, the gear end of the gear member being configured to engage with the gear grooves on the pull rod; and the second handle is connected to the transmission mechanism, and configured to drive the gear member of the transmission mechanism to rotate when the second handle is rotated and opened relative to the first handle such that the gear member pushes the pull rod forward by engagement between the gear end and the gear grooves, and to drive the gear member of the transmission mechanism to rotate when the second handle is rotated and closed relative to the first handle such that the gear end of the gear member pulls the pull rod backward by engagement between the gear end and the gear grooves;

wherein the transmission mechanism comprises a connecting rod configured to transfer a motion of the second handle to the gear member;

wherein a first end of the connecting rod is rotatably connected to the second handle by a first pin shaft, and a second end of the connecting rod is rotatably connected to a tail end of the gear member by a second pin shaft.

2. The rivet gun according to claim 1, wherein the second handle, the connecting rod, and the gear member are configured to define a double rocker mechanism.

3. The rivet gun according to claim 2, wherein connection lines of axes of the first fixed shaft, the second fixed shaft, the first pin shaft, and the second pin shaft are configured to define a parallelogram.

4. The rivet gun according to claim 1, wherein the gear member is made of a plurality of pieces stacked on each other.

5. The rivet gun according to claim 1, wherein a torsion spring is arranged between the first handle and the second handle.

6. The rivet gun according to claim 1, wherein the clamping-pulling mechanism further comprises a push rod, a spring, a claw, a restraining member, and a lead-in head; wherein the claw is arranged in an inner cavity of the restraining member, the claw and the restraining member are provided with mutually-engaged ramps, the push rod and the spring are arranged in an inner cavity of the pull rod in sequence, the restraining member is sleeved onto the pull rod, the clamping-pulling mechanism is such configured that when the pull rod is pushed forward, the lead-in head is abutted against the claw such that the claw compressing the spring by the push rod, the ramps are separated from each other, and the claw is opened, and when the pull rod is pulled back, under action of a restoring force of the spring, the push rod pushes the claw to cause the ramps to engage with each other, and the claw is tightened under a reaction force of the ramps.

7. The rivet gun according to claim 1, wherein needles or balls are arranged between the pull rod and the housing.

8. The rivet gun according to claim 1, wherein the first handle and the second handle are each provided with a handle sleeve, the handle sleeve of the first handle being provided with a protrusion; and tail portions of the first handle and the second handle are each further provided with a snap fastener.

* * * * *